US007431169B2

(12) United States Patent
Ishikawa et al.

(10) Patent No.: US 7,431,169 B2
(45) Date of Patent: Oct. 7, 2008

(54) SYNTHETIC RESIN BOTTLE WITH A HANDLE

(75) Inventors: Hiroaki Ishikawa, Tokyo (JP); Masaaki Sasaki, Tokyo (JP); Takao Iizuka, Tokyo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 0 days.

(21) Appl. No.: 10/585,822

(22) PCT Filed: Jun. 16, 2005

(86) PCT No.: PCT/JP2005/011007

§ 371 (c)(1),
(2), (4) Date: Aug. 17, 2006

(87) PCT Pub. No.: WO2006/001208

PCT Pub. Date: Jan. 5, 2006

(65) Prior Publication Data

US 2007/0095785 A1 May 3, 2007

(30) Foreign Application Priority Data

Jun. 29, 2004 (JP) ..... 2004-191678

(51) Int. Cl.
*B65D 23/10* (2006.01)

(52) U.S. Cl. ..... 215/396; 215/384; 220/771

(58) Field of Classification Search ..... 215/396–398; 220/759, 771, 773

See application file for complete search history.

(56) References Cited

U.S. PATENT DOCUMENTS 250,276 A * 11/1881 Morris ..... 222/465.1
2,760,668 A * 8/1956 Wiederspan et al. ..... 215/395
3,100,576 A * 8/1963 Frank ..... 215/382
3,412,887 A * 11/1968 Swartwood et al. ..... 215/397
3,524,241 A * 8/1970 Mauck et al. ..... 29/774
3,990,596 A * 11/1976 Hoftman ..... 215/11.1
4,257,525 A * 3/1981 Thompson ..... 215/396
4,399,926 A * 8/1983 Eidels-Dubovoy ..... 220/288
4,724,971 A * 2/1988 Henline ..... 215/396

(Continued)

FOREIGN PATENT DOCUMENTS

JP U 56-81027 7/1981

(Continued)

*Primary Examiner*—Sue A Weaver
(74) *Attorney, Agent, or Firm*—Oliff & Berridge, PLC

(57) ABSTRACT

To provide a synthetic resin bottle with a handle that can be manufactured at a low cost and can be used reliably, a synthetic resin bottle with a handle includes a bottle; and a handle comprising a grip disposed at the upper rear portion of said bottle, an upper arm extending forward from the upper end of the grip, and a pair of lower arms that extends to the right and the left from the lower end of the grip and pinch body of the bottle from both sides. The fore-end of the upper fitting arm is fitted to neck ring formed in the lower portion of neck of the bottle and is secured firmly by undercut engagement with the neck ring, and wherein fore-ends of the pair of the lower arms are fitted to bases of a pair of raised portions disposed on both sidewalls of the body of the bottle similarly by the undercut engagement with the raised portions.

13 Claims, 7 Drawing Sheets

U.S. PATENT DOCUMENTS

| | | | | | |
|---|---|---|---|---|---|
| 4,856,673 | A | * | 8/1989 | Thompson | 220/760 |
| 4,915,241 | A | * | 4/1990 | Morimura et al. | 215/398 |
| 4,982,868 | A | * | 1/1991 | Robbins, III | 220/742 |
| 5,469,612 | A | * | 11/1995 | Collette et al. | 29/453 |
| 5,484,081 | A | * | 1/1996 | Jahn | 220/759 |
| 6,068,901 | A | * | 5/2000 | Medal | 428/35.7 |
| 6,872,116 | B1 | * | 3/2005 | Dunnum et al. | 446/73 |

FOREIGN PATENT DOCUMENTS

| | | | |
|---|---|---|---|
| JP | A 02-032950 | | 2/1990 |
| JP | U 05-061035 | | 8/1993 |
| JP | 7251843 | * | 10/1995 |
| JP | A 08-11889 | | 1/1996 |
| JP | A 2000-006937 | | 1/2000 |

* cited by examiner

[Fig.1]
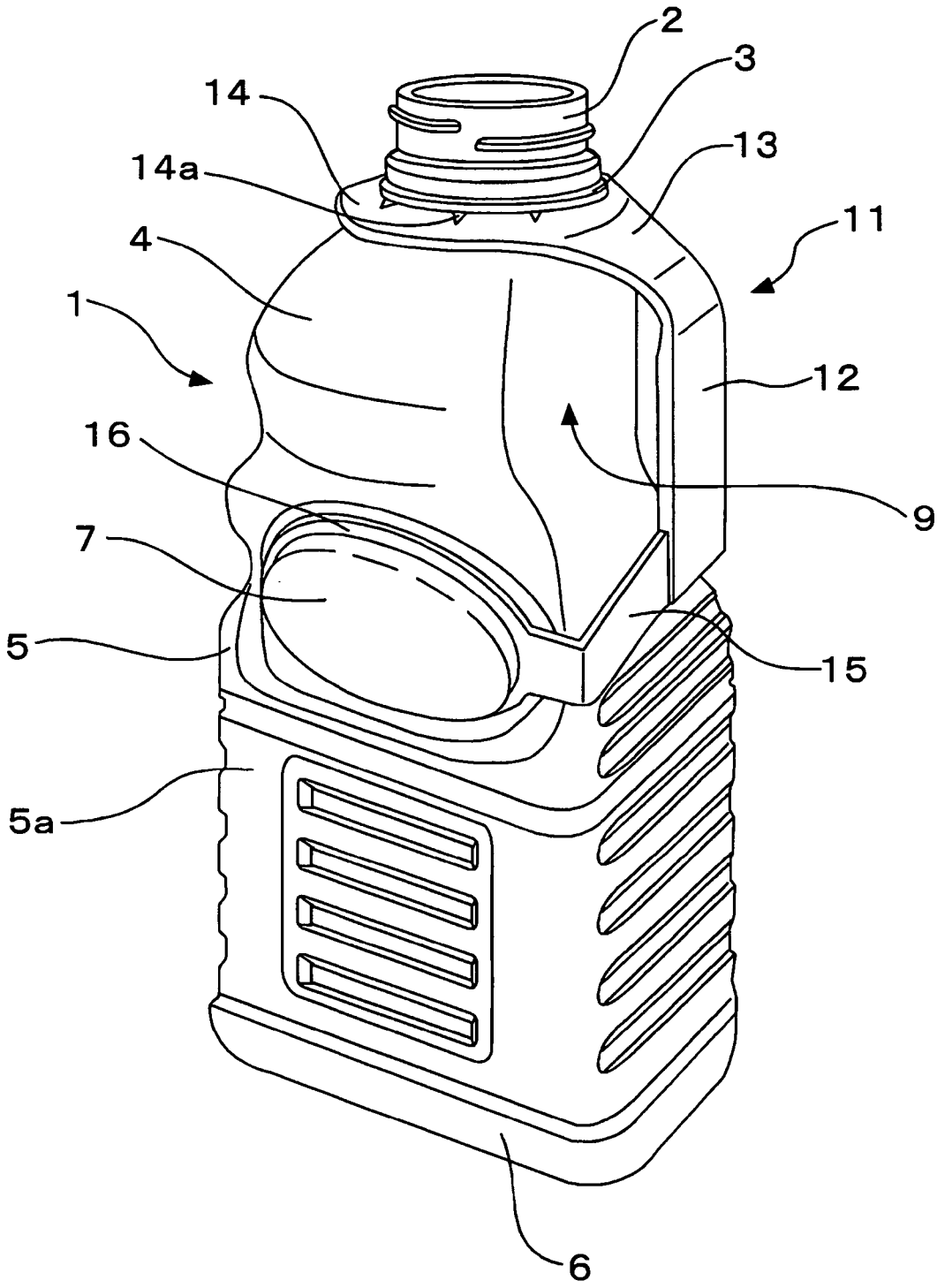

[Fig.2]
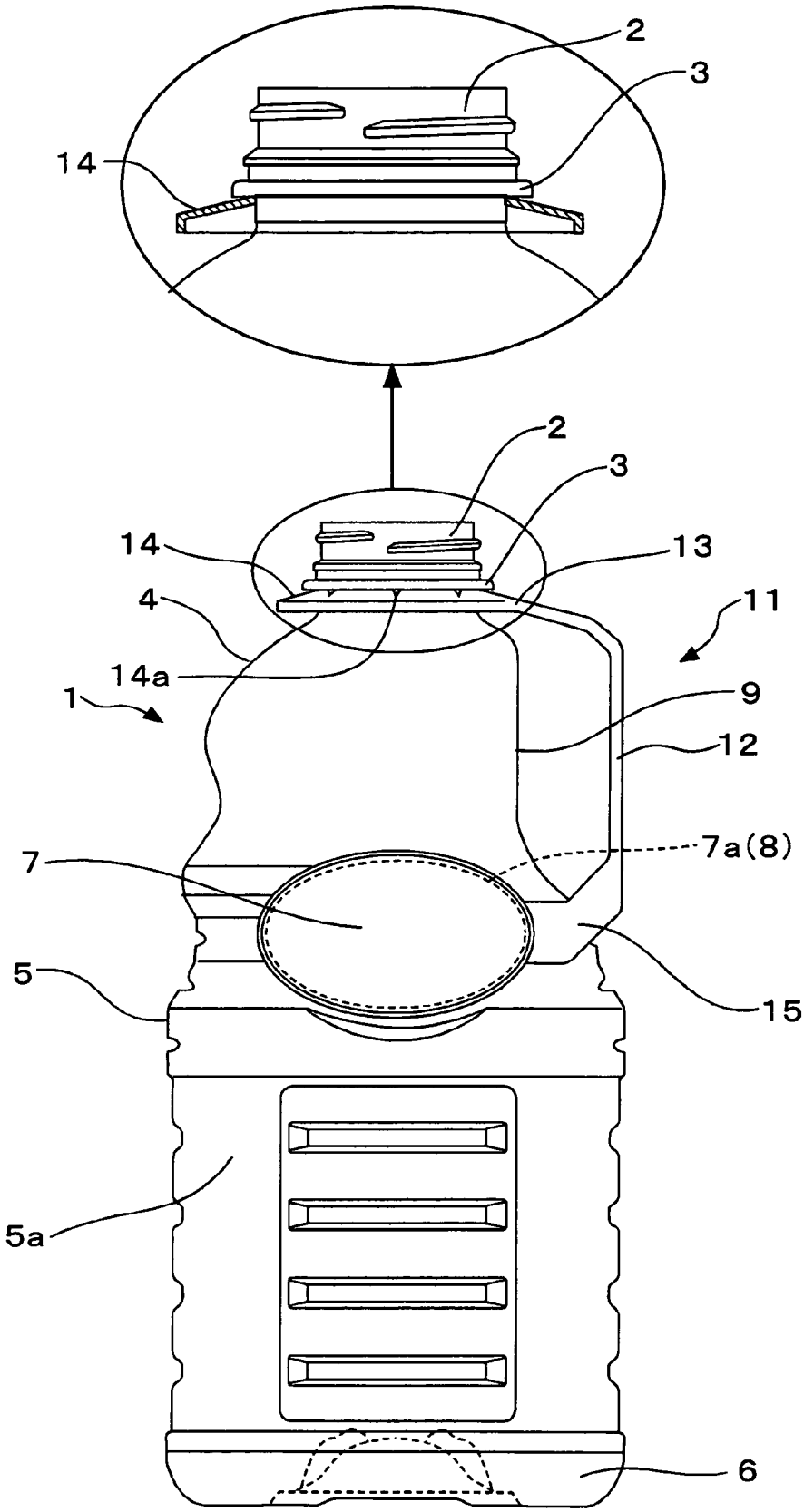

[Fig.3]
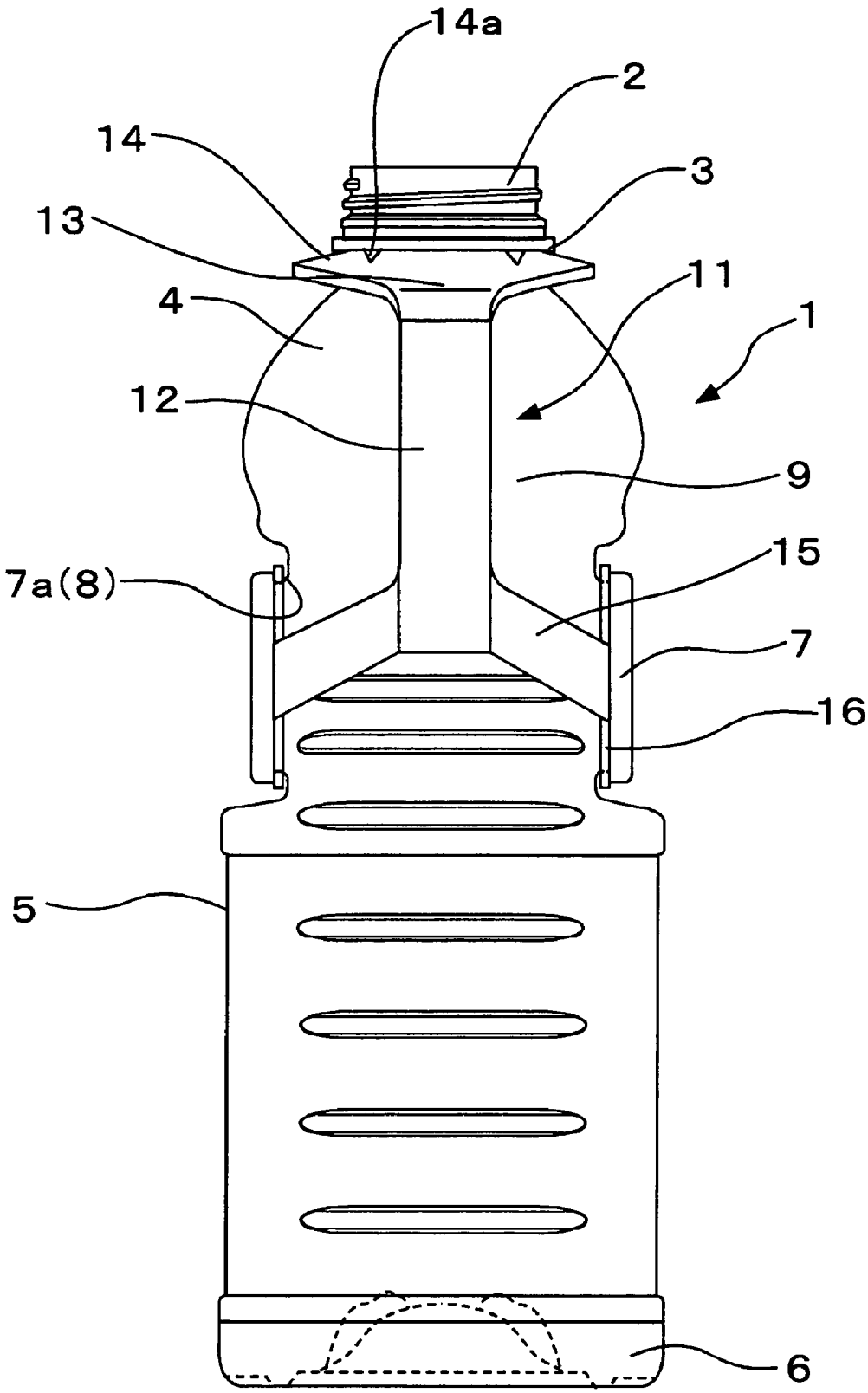

[Fig.4]
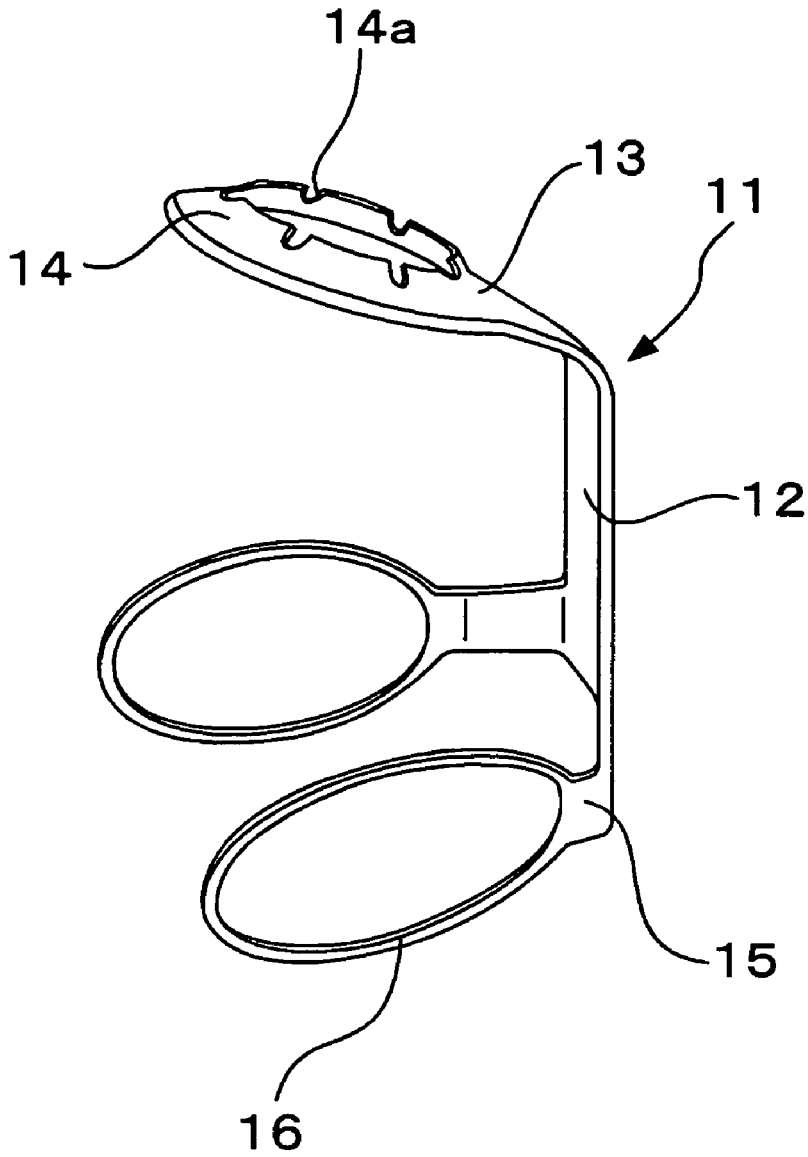

[Fig.5]
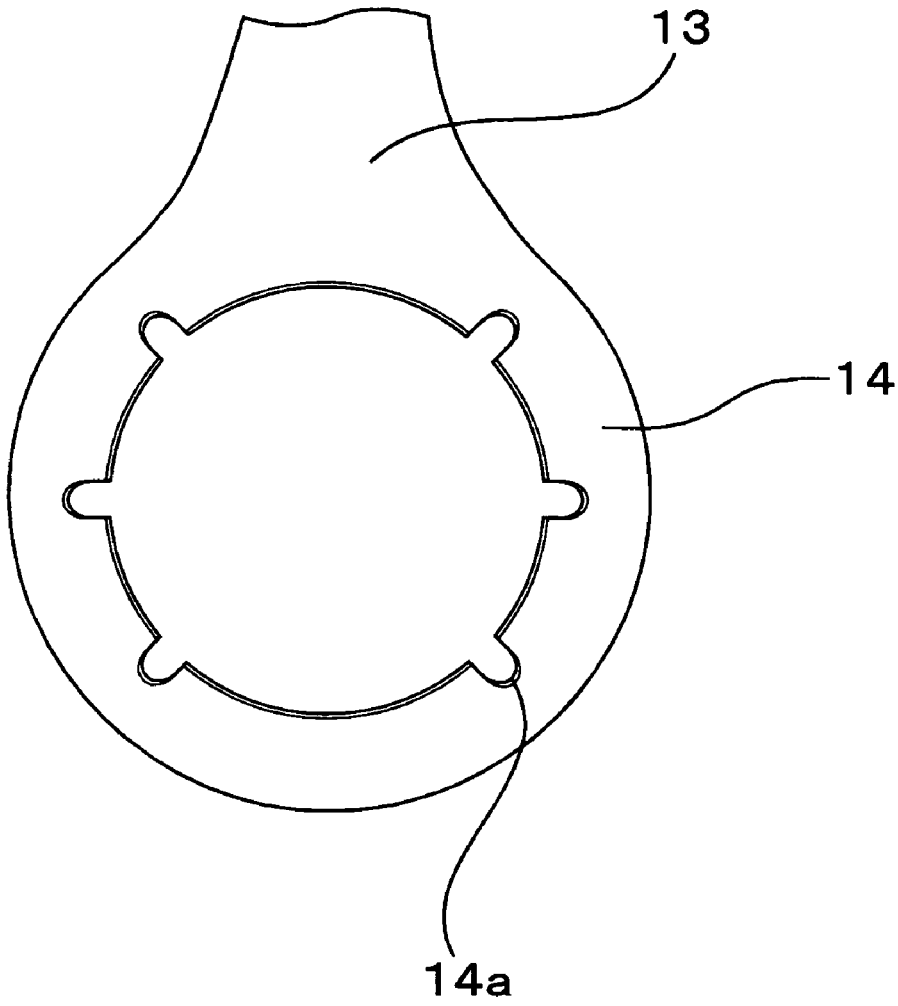

[Fig.6]
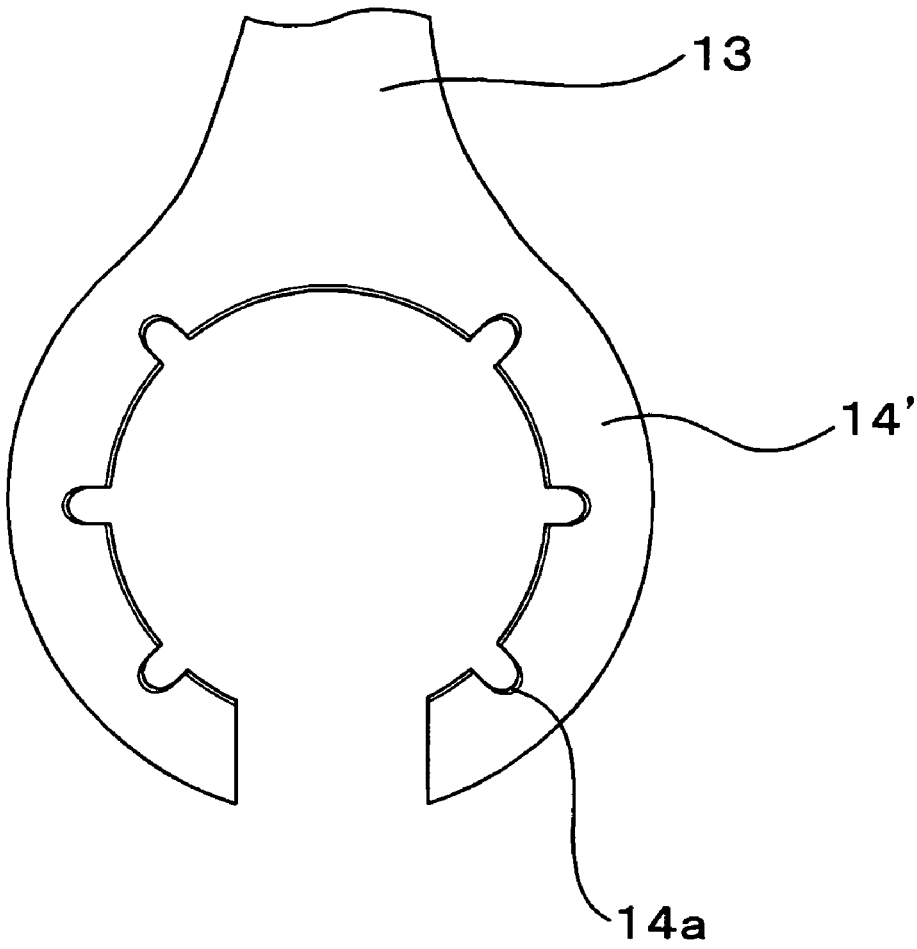

[Fig.7]
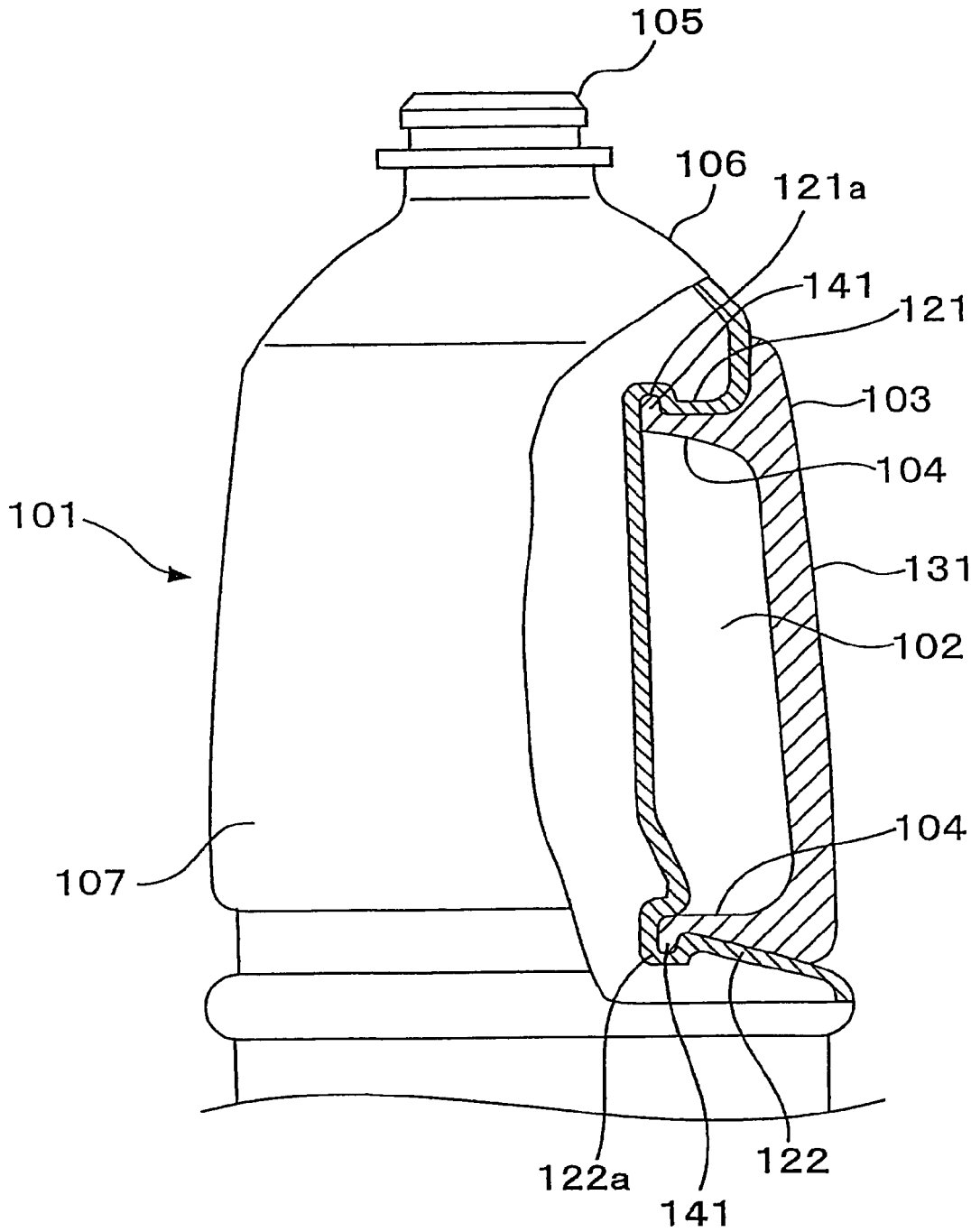
RELATED ART

SYNTHETIC RESIN BOTTLE WITH A HANDLE

TECHNICAL FIELD

This invention relates to a synthetic resin bottle to which a handle has been fitted and secured firmly.

BACKGROUND OF THE INVENTION

As a representative synthetic resin bottle with a handle, in which separately molded bottle and handle have been assembled, there may be mentioned a bottle shown in Patent Document 1. FIG. 7 shows a partly sectioned side view of a part of the bottle with a handle shown in Patent Document 1. The bottle comprises a container 101 and a handle 103. The container 101 is biaxially drawn and blow molded from a polyester resin mainly made of polyethylene terephthalate. It comprises a neck 105, a shoulder 106, a body 107, and a bottom. The body 107 has a recessed space 102 for fitting the handle 103.

The handle 103 for holding the container 101 comprises a grip 131 and upper/lower arms 104 that extend through the recessed space 102 to the container 101. Projected stoppers 141 at the tip of the fitting arms 104 are fitted to the container 101 by the engagement with recessions 121*a* and 122*a* that are formed in the innermost of downward face 121 and a slope 122. [Patent Document 1] Publication No. JP 2000-6937 A.

SUMMARY OF THE INVENTION

The handle in the above-described shape is advantageously utilized with a focus on large-size bottles. Since the handle 103 is fitted and secured to the container 101 at two engaging recessions 121*a* and 122*a* in the upper and lower portions of the handle, the load associated with the weight of the bottle filled with contents is centered on these two points. There may be some cases where it becomes difficult to support the bottle with a handle in a steady state unless the handle and the container are designed to have high rigidity by making the container wall and the handle thick and tough and by building up a high-precision fitting structure of the engaging recessions 121*a* and 122*a* in which to fit the projected stoppers 141 disposed at the fore-ends of the fitting arms 104.

A problem to be solved by this invention is to create a handle of a simple structure, which is capable of dispersing the load stably and is easy to mold and assemble. Another problem is to create this handle-fitting structure of high precision. The object of this invention is to provide a synthetic resin bottle with a handle that can be manufactured at a low cost and can be used reliably.

The means to solve the above-described problems is a synthetic resin bottle with a handle, which comprises:

a bottle; and a handle comprising a grip disposed in the upper rear portion of said bottle, an upper arm extending forward from the upper end of said grip, and a pair of lower arms that extends to the right and the left from the lower end of said grip and pinch body of the bottle from both sides, wherein fore-end of said upper arm is fitted and secured firmly to a neck ring formed in the lower portion of neck of said bottle by undercut engagement with the neck ring, and wherein fore-ends of the pair of said lower arms are fitted and secured to bases of a pair of raised portions disposed on both sidewalls of the body of the bottle similarly by the undercut engagement with said raised portions.

Under this configuration, the handle is fitted to the bottle at the three points of the neck ring and the bases of a pair of raised portions, and is secured firmly by the undercut engagement with the neck ring and the bases. The load associated with the weight of the bottle filled with contents can be supported under the condition of a weight dispersed among these three points. The contents can be poured out of the bottle stably and reliably by holding the grip disposed at the rear of the bottle.

The load of the bottle can be supported by the handle under the condition that the load is dispersed among the neck and both sides of the body, and thus, the load is not centralized on the rear wall alone of the body. Therefore, even if the bottle has a relatively thin wall, it can be utilized safely without causing the bottle to be deformed due to the load.

The handle can be molded from a combination of relatively thin plates or even from a synthetic resin material having substantial flexibility, and can be fitted and secured firmly to the bottle by the undercut engagement therewith.

In addition, an upper fitting ring may be formed at the fore-end of the upper arm, and arm fitting rings are formed at the fore-ends of a pair of lower arms. These upper fitting ring and arm fitting rings are fitted around the base of the neck ring and the bases of the raised portions, respectively, and are secured firmly by the undercut engagement with the bases.

Under this configuration the undercut engagement described above ties the upper fitting ring and the arm fitting rings to the base of the neck ring and the bases of raised portions so firmly that these fitting rings are kept reliably from coming free from the undercut engagement. Each fitting can be withheld from bumpy contact, and the bottle is held steadily, thus making it easy to pour the contents out of the bottle smoothly or to handle the bottle for whatever purposes.

Further the arm fitting rings may be secured firmly by the undercut engagement with at least a lower half round of the respective bases of the raised portions.

When the arm fitting rings are fitted around the raised portions, it is not always necessary for the arm fitting rings to be secured by the undercut engagement along the entire circumference of the raised portion bases, while fitting operability is taken into consideration. As long as each arm fitting ring is fitted around the raised portion base by the undercut engagement with at least a lower half round of the base periphery, as described in the configuration of claim 3, these fitting rings can be kept reliably from coming free from the undercut engagement with the raised portions. Each fitting can be withheld from bumpy contact.

As described above, each arm fitting ring is fitted around the raised portion base by the undercut engagement with at least a lower half round of the base periphery. When a bottle filled with the contents is held with a hand in this state of engagement, the weight of the bottle can be supported securely by the undercut fitting portions along respective lower half rounds, and thus, the bottle can be handled stably.

Moreover, an insert molding method may be use to fit the fore-ends of the lower arms around the bases of a pair of raised portions disposed on both sidewalls of the body of the bottle and to secure the fore-ends firmly by the undercut engagement with these bases.

The undercut engagement is performed by pushing the fore-ends of the upper and lower arms of a separately molded handle onto respective receiving portions of the bottle. At that time, the insert molding method can also be used to fit the fore-ends of lower arms around the bases of a pair of raised portions disposed on both sidewalls of the body of the bottle and to secure the fore-ends firmly by the undercut engagement with these bases. Thus, the arm fitting rings can be fitted more firmly and reliably to both sides of the body.

In this case, it is difficult to fit the upper fitting ring to the neck ring at the same time. The upper fitting ring is fitted to the neck ring in a post-process.

Furthermore, the body of the bottle may have a rectangular bottle shape.

Under the configuration of claim 5, both sidewalls of the body face each other. Therefore, both sidewalls of the body can be pinched and held by a pair of lower arms from the right and the left in a stable posture.

Additionally a recessed space may be formed in the rear, upper portion of the body of the bottle and wherein the grip is disposed upright at the rear of the bottle with the recessed space in between.

Under the configuration of claim 6, a recessed space is formed in the upper, rear portion of the body of the bottle. One can insert fingers into the space between the body wall and the grip and keep a stable pouring posture while holding the grip of the bottle. Since the grip is not projected largely from the bottle, the bottles can be stored or displayed conveniently.

Yet futher, the bottle may be a biaxially drawn, blow molded product made of a resin of a polyethylene terephthalate series.

Biaxially drawn, blow molded bottles made of a PET-related resin are widely in use as the bottles for beverages, and have high mechanical properties at high and low temperatures.

PET is mainly used as the PET-related resin. In addition to a major part of ethylene terephthalate units, those copolymerized polyesters containing other polyester units can also be used unless the essential quality of the PET-related resin is spoiled. For example, a PET-related resin can be blended with a nylon-related resin or a polyethylene naphthalate resin to improve the gas barrier property or the heat-resisting property. The ingredients for use in copolymerized polyesters include dicarboxylic acids, such as isophthalic acid, naphthalene-2,6-dicarboxylic acid, and adipic acid; and glycol ingredients, such as propylene glycol, 1,4-butanediol, tetramethylene glycol, neopentyl glycol, cyclohexane dimethanol, and diethylene glycol.

Furthermore, PET-related resin bottle may be provided with an intermediate layer of a nylon resin, as exemplified by the layers consisting of a PET resin—a nylon resin—a PET resin, for the improvement of the heat-resisting property and/or gas barrier property.

This invention having the above-described configuration has the following effects:

The weight of the bottle filled with the contents can be dispersed and supported by 3 points of the neck and both sidewalls of the body. The contents can be poured out of the bottle stably and reliably by holding the grip disposed at the rear of the bottle.

Since the load is not centralized on one portion of the body, the bottle can be utilized safely without causing any deformation due to the load, even if the bottle has a relatively thin wall. The handle can be molded from a combination of relatively thin plates or even from a synthetic resin material having substantial flexibility. A simple structure is utilized for the handle and the fitting of handle to bottle. Thus, the bottle and the handle can be molded and assembled easily by the undercut engagement.

Rings may be used as the handle-to-bottle fittings. This configuration ensures that the handle can be kept reliably from coming free from the undercut engagement. Each fitting can be withheld from bumpy contact, and the bottle can be handled steadily.

As long as each arm fitting ring is fitted around the raised portion base and is secured firmly by the undercut engagement with at least a lower half round of the base periphery, these fitting rings can be kept reliably from coming free from the undercut engagement with the raised portions. Each fitting can be withheld from bumpy contact. When the bottle is held with a hand, the weight of the bottle and the contents can be supported securely by the undercut engagement with respective lower half rounds, and thus, the bottle can be handled stably.

The insert molding method ensures that the lower arms are fitted and secured firmly to both sidewalls of the body.

Both sidewalls of the body face each other. Due to this configuration, both sidewalls of the body can be pinched and held by a pair of lower arms from the right and the left in a stable posture.

One can insert fingers into the space between the body wall and the grip and keep a stable pouring posture while holding the grip of the bottle. Since the grip is not projected largely from the bottle, the bottles can be conveniently stored or displayed.

The biaxially drawn, blow molded bottle,made of a PET-related resin and equipped with a handle, can be utilized widely in various applications.

BRIEF DESCRIPTION OF THE DRAWINGS

FIG. 1 is a perspective view of the bottle in one embodiment of this invention.

FIG. 2 is a side view of the bottle shown in FIG. 1.

FIG. 3 is a rear view of the bottle shown in FIG. 1.

FIG. 4 is a perspective view of the handle used with the bottle of FIG. 1.

FIG. 5 is a plan view of the foremost portion of the upper arm of the handle shown in FIG. 4.

FIG. 6 is a plan view of the foremost portion of the upper arm in another embodiment.

FIG. 7 is a side view, with partial vertical section, of a bottle with a handle in conventional art.

DETAILED DESCRIPTION OF THE INVENTION

This invention is further described with respect to a preferred embodiment, now referring to the drawings. FIGS. 1-5 show the synthetic resin bottle with a handle in one embodiment of this invention. The bottle 1 is a biaxially drawn, blow molded bottle made of a PET resin and having a capacity of 1.5 liters. The bottle 1 generally has a rectangular bottle shape and comprises a neck 2, a shoulder 4, a body 5, and a bottom 6 in which the bottom plate is formed into the shape of a dome. A recessed space 9 is formed in the portion ranging from the rear shoulder 4 to the upper part of the body 5.

A neck ring 3 in a peripheral brim shape is formed at the base of the neck 2. An elliptical raised portion 7 is projected from each sidewall 5*a* of the body 5 across the almost entire width of this sidewall 5*a*.

FIG. 4 is a perspective view of the entire handle 11, which is an injection molded product made of a synthetic resin. The handle 11 comprises a grip 12 in the shape of a longitudinal plate to be held with a hand, an upper arm 13 extending forward from the upper end of the grip 12, and an upper fitting ring 14 that is disposed at the fore-end of the upper arm 13 and is fitted around the neck ring 3 of the bottle 1 and secured firmly by the undercut engagement with the neck ring 3.

The handle 11 also comprises a pair of lower arms 15 that extends forward from the right and left of the grip 12 at its lower end so that the lower arms 15 pinch the body 5 from outside. At the fore-end of each lower arm 15 is an arm fitting ring 16, which is fitted around the base of a raised portion 7 projecting from a sidewall 5*a* of the bottle 1 and is secured firmly by the undercut engagement with this base.

In this embodiment, the handle 11 is made of a synthetic resin material having a substantial flexibility, such as polypropylene, low-density polyethylene, or polypropylene blended with rubber, so as to facilitate the operation (or process) of undercut engagement of the upper fitting ring 14 and the arm fitting rings 16 with the bottle 1.

The upper fitting ring 14 has several cut-outs 14*a* disposed along the inner circumference so that the ring 14 can easily climb over the neck ring 3. In addition, the upper fitting ring 14 has a thickness of about 0.7 mm in the vicinity of the inner circumference. Similarly, the arm fitting rings 16 have a ring width of about 3 mm and a thickness of about 1.5 mm to ensure that the rings 16 can deform and widen enough to be fitted around the bases of raised portions 7 and secured firmly by the undercut engagement with the bases.

FIGS. 1, 2, and 3 show the bottle 1 in the state in which the handle 11 has been fitted and secured firmly. The upper fitting ring 14 is fitted to the neck ring 3 by the undercut engagement in such a way that the inner peripheral portion of the upper fitting ring 14 is fitted around the base of the neck ring 3 (See the partially enlarged view of FIG. 2 shown in a circle above the bottle 1). The arm fitting rings 16, too, are fitted around the raised portions 7 by the undercut engagement in such a way that each ring 16 is fitted into a peripheral groove 7*a* formed at the base of a raised portion 7.

Under these fitting conditions, the three fitting portions make it possible to disperse effectively the load associated with the weight of the bottle 1 that has been filled with the contents. The bottle 1 can be held steadily during the time when the contents are poured out because there is no large deformation of the bottle 1 and no fitting portion getting bumpy.

The arm fitting rings 16 are thus fitted in the peripheral grooves 7*a* formed at the bases of the raised portions 7. As a result, these rings 16 are fitted to the raised portions 7 by the undercut engagement with the groove along the entire circumference. For better operability, the undercut engagement can be limited only to a lower half round of each raised portion 7. The shape of the fitting portions may be determined by giving consideration to the weight of the bottle filled with the contents, the depth of the undercut, and easy handling of the bottle.

The fore-end of the upper arm 13 need not always have a ring shape. For example, as shown in FIG. 6, the foremost part of the upper fitting ring 14 shown in FIG. 5 may be cut out to form a C-shaped fitting portion 14*a* for the convenience of easy assembling operation. The fore-ends of the arm fitting rings 15, too, may not necessarily be circular.

The insert molding method can also be utilized when the arm fitting rings 16 is fitted around the bases of the raised portions 7 by the undercut engagement. At the time of insert molding, the upper arm is held upright, and is fitted to the neck ring 3 in the post-process.

The bottle 1 in this embodiment has a recessed space 9 at the rear of the bottle, ranging from the shoulder 4 to the upper area of the body 5. The grip 12 is disposed behind this recessed space 9, and one can insert fingers into the space between the body wall and the grip and keep a stable pouring posture while holding the grip of the bottle. Since the grip is not projected largely from the bottle, the bottles can be stored or displayed conveniently. Depending on the purpose of use, the recessed space 9 may not be provided, and instead, the grip 12 can be projected rearward from the bottle 1.

In this embodiment, the raised portions 7 in an elliptical shape are projected from the sidewalls 5*a* of the body 5 across the almost entire width of these sidewalls 5*a*. At this width, the raised portions 7 can disperse the load of the bottle 1 more effectively than usual. In addition, characters or letters of a relief structure can be formed on these raised portions 7, or labels can be attached thereto, thus allowing the raised portion 7 to be effectively utilized as decorative or display surfaces. The raised portions 7 are not limited to an elliptical shape but can be selected suitably from among a circular, oval, or rectangular shape, after due consideration has been given to the appearance, easiness to assemble the handle, and firm fitting condition.

This invention is not limited to the embodiments described above. For example, the bottle material is not limited to the resins of PET, but also includes polyethylene, polypropylene, or other synthetic resins that have been used conventionally. The bottle shape, too, is not limited to a rectangular shape.

The synthetic resin bottle with a handle according to this invention has a simple structure and can stably disperse its load of weight. The bottle can be used stably at a low cost, thus promising a wide variety of applications.

The invention claimed is:

1. A synthetic resin bottle with a handle, comprising:

a bottle having sidewalls; and the handle comprising a grip disposed in an upper rear portion of said bottle, an upper arm extending forward from an upper end of said grip, and a pair of lower arms that extends to the right and the left from a lower end of said grip and pinches a body of the bottle from both sides, arm fitting rings being formed at fore-ends of the pair of lower arms, wherein a fore-end of said upper arm is fitted and secured firmly to a neck ring formed in a lower portion of a neck of said bottle by an undercut engagement with the neck ring, wherein the arm fitting rings are fitted and secured to bases of a pair of raised portions with an undercut disposed on opposed sidewalls of the body of the bottle respectively by an undercut engagement with said raised portions, and wherein an insert molding method is used to fit the fore-ends of the lower arms arm fitting rings around the bases of the pair of raised portions disposed on the opposed sidewalls of the body of the bottle and to secure the fore-ends firmly by the undercut engagement with these bases.

2. The synthetic resin bottle with the handle according to claim 1, wherein an upper fitting ring is formed at the fore-end of the upper arm, and wherein said upper fitting ring is fitted around the base of the neck ring and is secured firmly by the undercut engagement with the neck ring.

3. The synthetic resin bottle with the handle, according to claim 1, wherein the arm fitting rings are fitted around the bases of the raised portions and are secured firmly by the undercut engagement with at least a lower half round of the respective bases of the raised portions.

4. The synthetic resin bottle with the handle according to claim 1, wherein the body of the bottle is in a rectangular bottle shape.

5. The synthetic resin bottle with a handle according to claim 1, wherein a recessed space is formed in the rear, upper portion of the body of the bottle, and wherein the grip is disposed upright at the rear of the bottle with the recessed space in between.

6. The synthetic resin bottle with the handle according to claim 1, wherein the bottle is a biaxially drawn, blow molded product made of a resin of a polyethylene terephthalate series.

7. The synthetic resin bottle with the handle according to claim 1, wherein the pair of raised portions are projected from each of the opposed sidewalls of the body across a substantial portion of a width of the sidewall.

8. The synthetic resin bottle with the handle according to claim 7, wherein an upper fitting ring is formed at the fore-end of the upper arm, and wherein said upper fitting ring is fitted around the base of the neck ring and is secured firmly by the undercut engagement with the neck ring.

9. The synthetic resin bottle with the handle, according to claim 7, wherein the arm fitting rings are fitted around the bases of the raised portions and are secured firmly by the undercut engagement with at least a lower half round of the respective bases of the raised portions.

10. The synthetic resin bottle with the handle according to claim 7, wherein the body of the bottle is in a rectangular bottle shape.

11. The synthetic resin bottle with the handle according to claim 7, wherein a recessed space is formed in the rear, upper portion of the body of the bottle and wherein the grip is disposed upright at the rear of the bottle with the recessed space in between.

12. The synthetic resin bottle with the handle according to claim 7 wherein the bottle is a biaxially drawn, blow molded product made of a resin of a polyethylene terephthalate series.

13. A synthetic resin bottle with a handle, comprising:

a bottle having sidewalls; and the handle comprising a grip disposed in an upper rear portion of said bottle, an upper arm extending forward from an upper end of said grip, and a pair of lower arms that extends to the right and the left from a lower end of said grip and pinches a body of the bottle from both sides, arm fitting rings being formed at fore-ends of the pair of lower arms, wherein a fore-end of said upper arm is fitted and secured firmly to a neck ring formed in a lower portion of a neck of said bottle by an undercut engagement with the neck ring, wherein the arm fitting rings are fitted and secured to bases of a pair of raised portions with an undercut disposed on opposed sidewalls of the body of the bottle respectively by an undercut engagement with said raised portions, and wherein the pair of raised portions are projected from each of the opposed sidewalls of the body across a substantial portion of a width of the sidewall.

* * * * *

UNITED STATES PATENT AND TRADEMARK OFFICE

CERTIFICATE OF CORRECTION

PATENT NO. : 7,431,169 B2
APPLICATION NO. : 10/585822
DATED : October 7, 2008
INVENTOR(S) : Hiroaki Ishikawa, Masaaki Sasaki and Takao Iizuka It is certified that error appears in the above-identified patent and that said Letters Patent is hereby corrected as shown below:

Column 6

Line 63, replace "5. The synthetic resin bottle with a handle according to"

with

--5. The synthetic resin bottle with the handle according to--.

Signed and Sealed this

Tenth Day of February, 2009

JOHN DOLL
*Acting Director of the United States Patent and Trademark Office*